US011120678B2

(12) United States Patent
Sugizaki

(10) Patent No.: US 11,120,678 B2
(45) Date of Patent: Sep. 14, 2021

(54) FIRE DETECTION SYSTEM

(71) Applicant: KABUSHIKI KAISHA TOSHIBA, Minato-ku (JP)

(72) Inventor: Yoshiaki Sugizaki, Fujisawa (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 16/570,524

(22) Filed: Sep. 13, 2019

(65) Prior Publication Data

US 2020/0302767 A1 Sep. 24, 2020

(30) Foreign Application Priority Data

Mar. 18, 2019 (JP) ..... JP2019-049899

(51) Int. Cl.
*G08B 17/117* (2006.01)
*G08B 25/00* (2006.01)
*G08B 17/107* (2006.01)

(52) U.S. Cl.
CPC ..... *G08B 17/117* (2013.01); *G08B 17/107* (2013.01); *G08B 25/006* (2013.01)

(58) Field of Classification Search
CPC ... G08B 17/117; G08B 17/107; G08B 25/006
USPC ..... 340/577
See application file for complete search history.

(56) References Cited

U.S. PATENT DOCUMENTS 5,281,816 A * 1/1994 Jacobson ..... G01N 21/31 250/338.5
5,331,310 A * 7/1994 Stetter ..... G01N 27/4045 204/406
6,876,305 B2 * 4/2005 Kadwell ..... G08B 17/107 250/573
8,077,046 B1 * 12/2011 Wong ..... G08B 17/107 340/501
8,114,509 B2 * 2/2012 Spichiger-Keller ..... B01D 71/027 428/312.2
8,559,006 B2 * 10/2013 Penney ..... F21V 7/30 356/337
10,234,388 B2 * 3/2019 Ebata ..... G08B 29/188
2020/0080977 A1 3/2020 Isobayashi et al.

FOREIGN PATENT DOCUMENTS

JP 2020-41947 A 3/2020

OTHER PUBLICATIONS

Katharina Heitmann, et al., "Chemical causes of the typical burnt smell after accidental fires", Analytical and Bioanalytical Chemistry, vol. 395, No. 6, Sep. 4, 2009, pp. 1853-1865.

(Continued)

*Primary Examiner* — John A Tweel, Jr.
(74) *Attorney, Agent, or Firm* — Oblon, McClelland, Maier & Neustadt, L.L.P.

(57) ABSTRACT

According to one embodiment, a fire detection system includes a combustion gas detection sensor, first chemical sensor configured to detect a first gas, and alarm configured to operate based on detection signals of the combustion gas detection sensor and the first chemical sensor and notify fire.

16 Claims, 9 Drawing Sheets

(56) References Cited

OTHER PUBLICATIONS

Kyoko Kamiya et al., "Experimental Study on Odor Intensity and Quality from Wood Materials in Oxidative pyrolysis", Bulletin of Japan Association for Fire Science and Engineering, vol. 63, No. 2, 2013, pp. 25-35 (with English Abstract & Computer Generated English Translation).

Zhou Lanxi, "Physiological Activities of Odors Generated from Amino Acids or Peptides by the Maillard Reaction", Abstract of Thesis or Dissertation, 2016, 8 pages (with Computer Generated English Translation).

"About Fire Odor Measures", Calmore, Dec. 1, 2007, 12 pages (with Computer Generated English Translation) https://www.karumoa.co.ip/wp-content/uploads/2018/10/burnt_odor_countermeasure.pdf.

"How to Choose a Residential Fire Alarm", Fire Alarm for Homes Quick Guide, SECOM, 2016, 23 pages, (with Computer Generated English Translation) https://www.secom.co.jp/jukelkl/select.html.

"Sensor", Fire Fighting Equipment Quick Lecture, Japan Fire Equipment Inspection Institute, Feb. 2019, 16 pages, (with Computer Generated English Translation) http://www.jfeii.or.jp/pdf/lecture/07.pdf.

"Sensor Type", Japan Fire Alarms Manufacturer's Association, 2018, 4 pages, (with Computer Generated English Translation) http://www.kaho.or.jp/user/eg/eg02/p01.html.

* cited by examiner

FIRE DETECTION SYSTEM

CROSS-REFERENCE TO RELATED APPLICATIONS

This application is based upon and claims the benefit of priority from Japanese Patent Application No. 2019-049899, filed Mar. 18, 2019 the entire contents of which are incorporated herein by reference.

FIELD

Embodiments described herein relate generally to a fire detection system.

BACKGROUND

Fire detection systems can be roughly divided into those to detect smoke and those to detect heat. The fire detection system to detect smoke will be disposed on the ceiling of a room, and send alarm when detecting a certain amount of smoke. In recent years, the fire detection system of higher performance is required.

DETAILED DESCRIPTION

Figure 1:
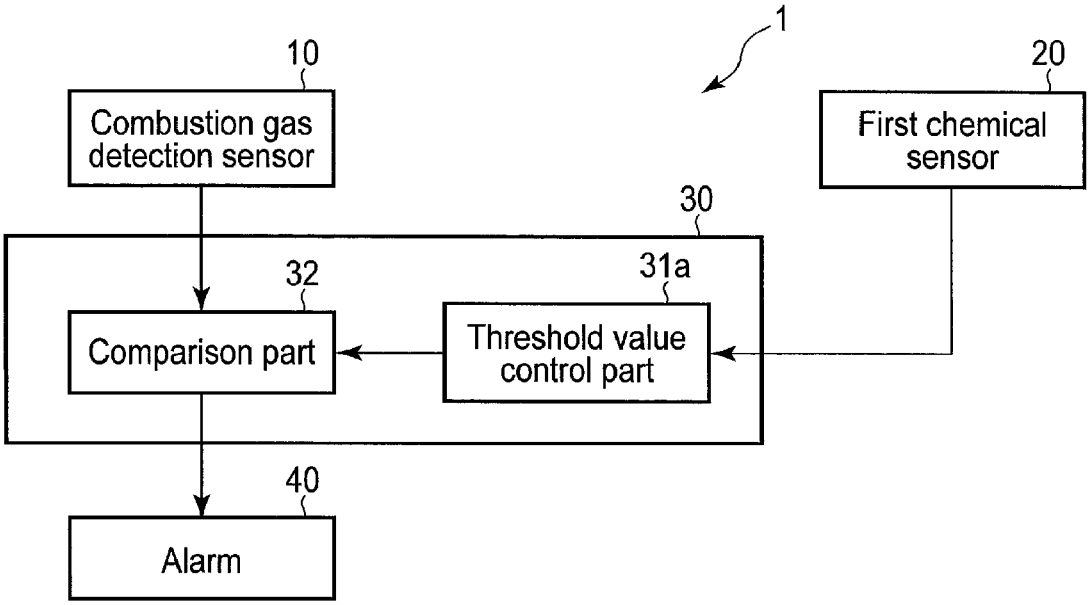
FIG. 1 illustrates an example of a fire detection system of a first embodiment.

In general, according to one embodiment, a fire detection system includes a combustion gas detection sensor, first chemical sensor configured to detect a first gas, and alarm configured to operate based on detection signals of the combustion gas detection sensor and the first chemical sensor and notify fire.

Hereinafter, various embodiments will be described with reference to the accompanying drawings. Each drawing is a schematic diagram for facilitating understanding of each embodiment, and a shape, a dimension, a proportion, and the like in the drawings may be different from actual ones. However, these can be appropriately modified in consideration of the following description and known technologies.

Hereinafter, fire detection systems of the embodiments will be described.

First Embodiment

FIG. 1 illustrates an example of a fire detection system of a first embodiment. The fire detection system 1 of the first embodiment includes a combustion gas detection sensor 10, first chemical sensor 20, controller 30, and alarm 40. The controller 30 includes a threshold value control part 31*a* and a comparison part 32.

Upon detection of a combustion gas, the combustion gas detection sensor 10 outputs a detection signal to the comparison part 32 of the controller 30. The combustion gas is, in this application, particles floating in the air which are generated when a material burns, and represents particles such as soot and metal. The combustion gas may contain a first gas. The first gas is particles of combustion gas which may be generated with a low possibility in a fire incident.

Upon detection of the first gas, the first chemical sensor 20 outputs a detection signal to the threshold value control part 31*a* of the controller 30. The threshold value control part 31*a* outputs a threshold value to the comparison part 32. The controller 30 outputs or does not output an operation start signal to the alarm 40 based on the detection signal from the combustion gas detection sensor 10 and the threshold value from the threshold value control part 31*a*. The alarm 40 operates based on the operation start signal from the comparison part 32 of the controller 30 and notifies fire.

Figure 2:
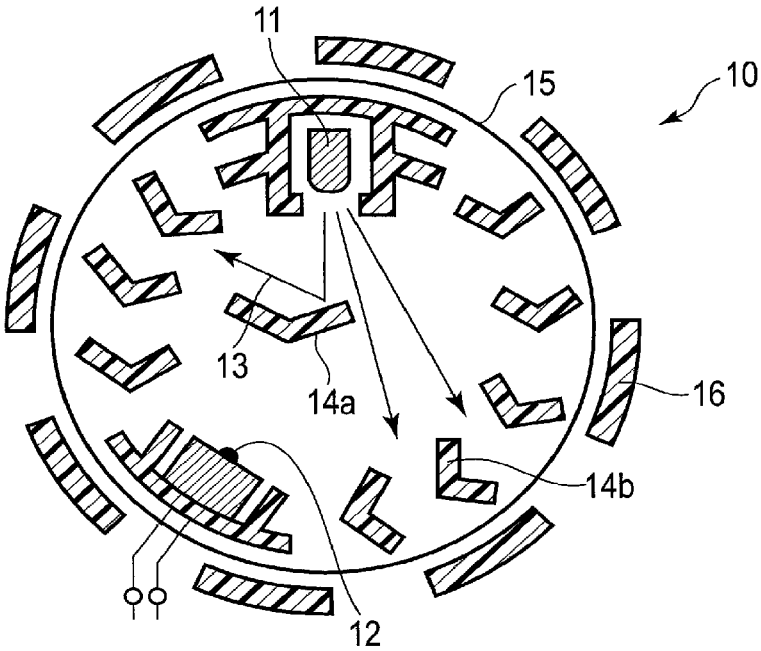
FIG. 2 illustrates a transverse cross-sectional view of a combustion gas detection sensor incorporated in the fire detection system of the first embodiment.

FIG. 2 illustrates a transverse cross-sectional view of the combustion gas detection sensor incorporated in the fire detection system of the first embodiment. As shown in FIG. 2, the combustion gas detection sensor 10 includes a light emitting element 11 and a light receiving element 12. Between the light emitting element 11 and the light receiving element 12, there are a first light shielding plate 14*a* which blocks direct incident of illumination light 13 from the light emitting element 11 onto the light receiving element 12 and a plurality of second light shielding plates 14*b* which blocks external light incident onto the combustion gas detection sensor 10. A ring-shaped filter 15 is disposed around the second light shielding plates 14*b* to surround the light emitting element 11, light receiving element 12, and first light shielding plate 14*a*, that is, a detection area. Here, the detection area is an area including the light emitting element 11, light receiving element 12, first light shielding plate 14*a*, and second light shielding plates 14*b*. In the outer periphery of the filter 15, an outer frame 16 is arranged with certain intervals therein.

The light emitting element 11 is arranged to be, for example, shifted to a certain angle from a position opposed to the light receiving element 12 such that the irradiation light 13 from the light emitting element 11 does not directly enter the light receiving element 12. The light emitting element 11 is, for example, a light emitting diode which flashes the irradiation light 13 at a-few-seconds intervals. The irradiation light 13 from the light emitting element 11 enters the light receiving element 12.

The first light shielding plate 14*a* is formed of, for example, a black light shielding material which absorbs the irradiation light 13. The light shielding material is, for example, polypropylene or polyethylene including carbon black. A plurality of the second light shielding plates 14*b* are formed of the same material as the first light shielding plate 14*a*, for example.

The filter 15 includes, for example, a plurality of apertures of 10 to 100 μm diameter in order to prevent dust, insect, or the like which is greater than a combustion gas (particle) 17 in size from entering in the detection area of the combustion gas detection sensor 10. The combustion gas (particle) 17 will be described later.

The outer frame 16 is formed of, for example, polypropylene, polyethylene, or a fluorine resin such as anti-ultraviolet ray polytetrafluoroethylene or polyvinylidene fluoride.

Figure 3:
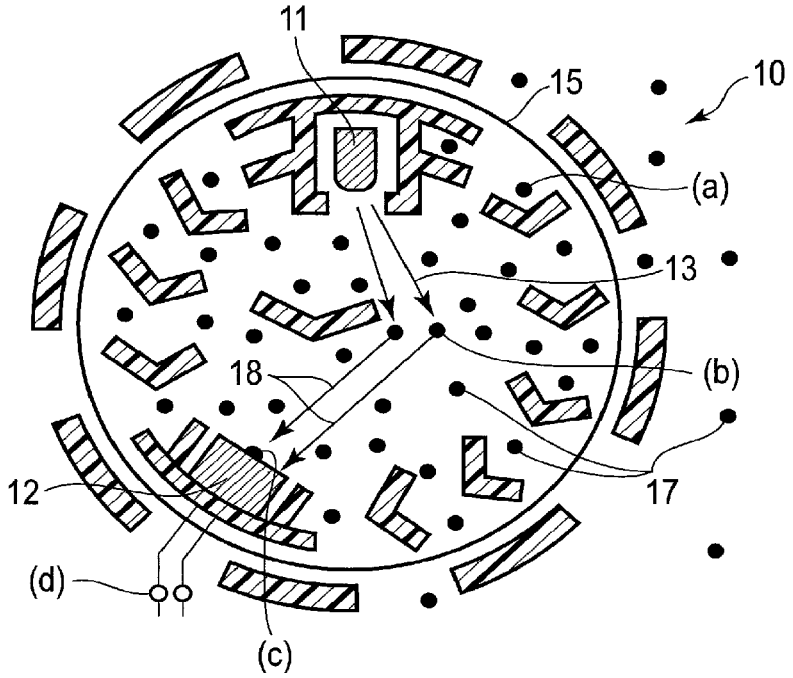
FIG. 3 illustrates an example of detection by the combustion gas detection sensor incorporated in the fire detection system of the first embodiment.

Hereinafter, the detection of combustion gas by the combustion gas detection sensor 10 will be explained with reference to FIG. 3. FIG. 3 illustrates an example of detection by the combustion gas detection sensor incorporated in the fire detection system of the first embodiment.

(S1): When a combustion gas is generated in a space where the fire detection system 1 is disposed, the combustion gas enters the detection area passing through the filter 15 of the combustion gas detection sensor 10. (S2): While the light emitting element 11 is lit, the irradiation light 13 is scattered by the combustion gas 17 in the detection area. (S3): The light receiving element 12 receives scattered light 18. The intensity of the scattered light 18 received by the light receiving element 12 correlates with the amount of combustion gas 17 entering in the detection area, and thus, when the amount of combustion gas increases, the intensity of received scattered light 18 increases. (S4): The intensity of the detected scattered light 18 is output as a detection signal to the comparison part 32 of the controller 30.

The above-described combustion gas detection sensor is a photoelectric type spot sensor. The combustion gas detection sensor is not limited to the photoelectric type spot sensor, and it may be a photoelectric separation type combustion gas detection sensor, or an ionized type combustion gas detection sensor.

The photoelectric separation type combustion gas detection sensor includes, for example, a light transmitting unit which releases a light beam to a space, and a light reception unit which is disposed to be opposed to the light transmitting unit. The space is between the light transmitting unit and the light reception unit. The light beam is released from the light transmitting unit toward the light reception unit to the space, and if a combustion gas is generated in a case of fire in the space, the intensity of the light beam is decreased by the combustion gas. The attenuation of the intensity of light beam correlates with the amount of the combustion gas, and thus, when the amount of combustion gas increases, the attenuation of the intensity of the light beam increases, and a detection signal therefrom will be used as in the first embodiment.

The ionized type combustion gas detection sensor generates ions by ionization of air by a ray, and if a combustion gas enters an ionized space, the amount of ions decreases since the ions are absorbed by the combustion gas. Thus, a change in ion current values is calculated by measuring current values in the ionized space before and after the entrance of the combustion gas, and a detection signal therefrom will be used as in the first embodiment.

Figure 4:
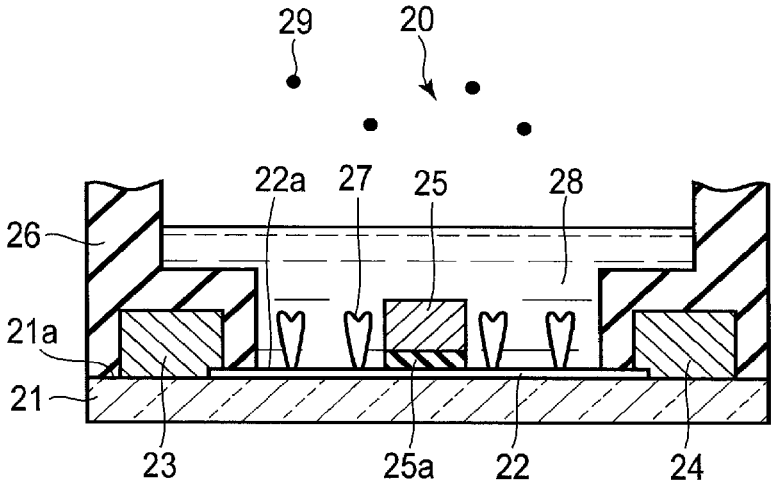
FIG. 4 illustrates a longitudinal cross-sectional view of a first chemical sensor incorporated in the fire detection system of the first embodiment.
Figure 5:
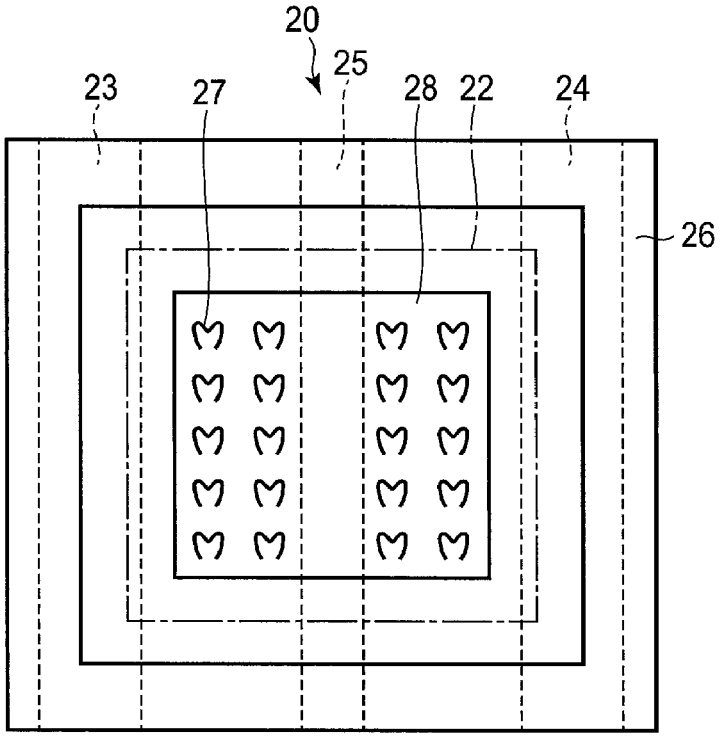
FIG. 5 illustrates a plan view of the first chemical sensor incorporated in the fire detection system of the first embodiment.

FIG. 4 illustrates a longitudinal cross-sectional view of a first chemical sensor incorporated in the fire detection system of the first embodiment. FIG. 5 illustrates a plan view of the first chemical sensor incorporated in the fire detection system of the first embodiment.

The first chemical sensor 20 includes a substrate 21. A membrane 22, source electrode 23 connected to one end of the membrane 22, and drain electrode 24 connected to the other end of the membrane 22 are provided on a surface 21*a* of the substrate 21. Between the source electrode 23 and the drain electrode 24, and on a surface 22*a* of the membrane 22, the gate electrode 25 is immersed in a liquid membrane 28 together with an insulating layer 25*a*. A wall portion 26 is disposed standing on the surface 21*a* of the substrate 21, and the wall portion 26 surrounds the membrane 22 in a plan view and covers the outer peripheral surface of the source electrode 23 and the drain electrode 24. In this example, a plan view indicates seeing the first chemical sensor 20 from the upper side of the surface 22*a* of the membrane 22. On the surface 22*a* of the membrane 22, a first receptor 27 is connected. On the surface 22*a* of the membrane 22, the liquid membrane 28 including a liquid is disposed to cover the first receptor 27. The term "cover" in the present embodiment means that at least a part of an element is covered. The first gas 29 is taken into the liquid membrane 28.

Note that the first chemical sensor 20 may include a hygroscopic ionic liquid as the liquid membrane 28 in order to maintain a wet state of the first receptor 27 by the liquid membrane 28. The wet state of the first receptor 27 maintained by the liquid membrane 28 is a state where the first receptor 27 is covered by the liquid membrane 28.

Furthermore, a state where the first receptor 27 is connected to the membrane 22 may be a state where the first receptor 27 is connected to the membrane 22 through chemical binding, or may be a state where the first receptor 27 is disposed on the surface 22*a* of the membrane 22.

Hereinafter, the first chemical sensor 20 will be described in detail.

The substrate 21 has, for example, a rectangular plate shape. The substance 21 is formed of silicon, glass, ceramic, a polymer material, metal or the like. A size of the substrate 21 is not limited. For example, a width of the substrate 1 is 1 to 10 mm, a length of the substrate 1 is 1 to 10 mm, and a thickness of the substrate 1 is 0.1 to 0.5 mm.

The substrate 21 may include an insulating film (not illustrated) on, for example, the surface 21*a*. The insulating film is formed of an electrically-insulating material such as silicon oxide, silicon nitride, aluminum oxide, a polymer material, a self-organized membrane of an organic molecule, or the like. The substrate 21 may include the insulating film disposed in the surface 21*a* side and a conductive layer functioning as a gate electrode. In that case, it is preferable that the thickness of the insulating film should be formed as thin as possible without deteriorating the insulating performance, and should be formed as a few nm, for example.

Such a thin membrane can be formed by, for example, an atomic layer deposition (ALD) method.

The membrane 22 is a membrane of which a physical property is changed when a structure of a substance binding thereto or a state of charge is changed. The membrane 22 is formed of, for example, a material electric resistance of which changes. The membrane 22 is a single layer graphene membrane having a thickness of one carbon atom. The graphene membrane may be a multilayer structure. The size of the membrane 22 is, for example, 1 to 500 μm×1 to 500 μm (width×length), although it is not limited thereto. Practically, a size of 10 to 100 μm×10 to 100 μm is suitable for production.

The membrane 22 is formed of, for example, a membrane or a nanowire of a polymer, silicon (Si), silicide, or the like, or a material such as graphene, a carbon nanotube, molybdenum disulfide ($MoS_2$) or tungsten diselenide ($WSe_2$).

The source electrode 23, drain electrode 24, and gate electrode 25 are formed of, for example, metal such as gold (Au), silver (Ag), copper (Cu), palladium (Pd), platinum (Pt), nickel (Ni), titanium (Ti), chromium (Cr), or aluminum (Al), or a conductive material such as zinc oxide (ZnO), indium tin oxide (ITO), indium gallium zinc semiconductor oxide (IGZO), or conductive polymer.

The source electrode 23, drain electrode 24, and gate electrode 25 are electrically connected to a power supply (not illustrated). Between the source electrode 23 and the drain electrode 24, when a voltage (source/drain voltage ($V_{sd}$)) is applied from the power source under a constant gate voltage, a current (source/drain current ($I_{sd}$)) flows from the source electrode 23 to the drain electrode 24 through the membrane 22. At that time, the membrane 22 as a graphene membrane functions as a channel of the source electrode 23 and the drain electrode 24. The gate electrode 25 changes the source/drain current by changing the gate voltage.

The insulating layer 25*a* is formed of, for example, oxide, nitride, or oxynitride of silicon, gallium, aluminum, and indium.

The wall portion 26 is formed of, for example, an electrically insulating material. Examples of the insulating material of the wall portion 26 include a polymer substance such as an acrylic resin, polyimide, polybenzoxazole, an epoxy resin, a phenol resin, polydimethylsiloxane, or a fluorine resin, or an inorganic insulating film such as silicon oxide, silicon nitride, or aluminum oxide, or self-organized membrane of an organic molecule.

The first receptor 27 is, for example, a biological material. As the first receptor 27, for example, a fragment of an olfactory receptor can be used. The first receptor 27 is a fragment of an olfactory receptor including a sequence of a site binding to the first gas 29. For example, such a sequence includes a ligand binding site positioned outside the cell of the olfactory receptor. The first receptor 27 can be produced by, for example, obtaining an amino acid sequence of the ligand binding side from a database of the olfactory receptors, and synthesizing an oligopeptide having the same amino acid sequence. The first receptor 27 may be a substance binding to the first gas 29, for example, may be a substance of which a sequence of a ligand binding site is partially changed, or may be a substance to which a new sequence is added. As the olfactory receptor, for example, an olfactory receptor of an animal can be used for the first receptor 27. Examples of the animal include a vertebrate or an insect. For example, an olfactory receptor of a human, a mouse, a fly, or the like can be used.

Furthermore, the first receptor 27 may be those binds to the first gas 29, an antibody, a nucleic acid aptamer, or an artificial material such as molecular imprint. If the first receptor 27 is an artificial material such as molecule imprint, the first receptor 27 is difficult to be denaturalized or deteriorated by drying.

The first receptor 27 can be connected to the membrane 22 by adding a modification group to the first receptor 27 and/or the membrane 22 and binding them through chemical synthesis. Furthermore, the first receptor 27 can be connected to the membrane 22 by being disposed on the surface 22*a* of the membrane 22.

Note that, on the surface 22*a* of the membrane 22, a blocking agent (not illustrated) may be disposed to cover the surface 22*a* in addition to the first receptor 27. The blocking agent may be, for example, a protein, organic molecule, lipid membrane, peptide, or nucleic acid. With the block agent, particles different from the first gas 29 (for example, particles of impurities) can be prevented from binding onto the surface of the membrane 22.

The liquid membrane 28 is disposed on the surface 22*a* of the membrane 22 to cover the first receptor 27. The liquid membrane 28 is, for example, water soluble liquid such as water, saline, or buffer solution, or an ionic liquid, and functions as a medium to carry the first gas 29 to the first receptor 27. Furthermore, the liquid membrane 28 is disposed to cover the first receptor 27, and thus, a change or deterioration of the first receptor 27 by drying can be prevented.

The liquid membrane 28 has a thickness between 0.5 and 10.0 μm inclusive, for example. The thickness of the liquid membrane 28 is, for example, a shortest distance from the surface 22*a* of the membrane 22 to an interface between the liquid membrane 28 and the air in FIG. 4. If the thickness of the liquid membrane 28 is below 0.5 μm, an outreach of the first gas 29 to the first receptor 27 is shortened, and the sensitivity of the chemical sensor may be improved; however, there is a possibility that the liquid membrane 28 is dried and the first receptor 27 is denaturalized or deteriorated because of the drying. Or, if the thickness of the liquid membrane 28 is above 10.0 μm, an outreach of the first gas 29 in an air sample to the first receptor 27 is extended, and the first gas 29 becomes difficult to reach the first receptor 27, and thus, there is a possibility that the sensitivity of the chemical sensor is decreased. It is preferable that the thickness of the liquid membrane 28 be between 0.5 and 5.0 μm inclusive, for example.

The first gas 29 is particles of combustion gas which has a low possibility of generation in afire incident. The first gas 29 may be a material included in the air and may be a ligand of animal olfactory receptor, for example. The first gas 29 is, for example, a decomposition product of a protein which is generated during cooking (when grilling a meat or the like), cigarette burn ingredient, insecticide/germicide smoke agent ingredient, and *Cannabis* product burn ingredient. The decomposition product of a protein which is generated during cooking is, for example, a nitrogen-containing organic compound such as 2, 3-dimethylpyrazine, or MPM. The cigarette burn ingredient is, for example, nicotine and a derivative thereof. The insecticide/germicide smoke agent ingredient is, for example, methoxyazone, or d,d-T-cyphenothrin. The *Cannabis* product burn ingredient is, for example, tetrahydrocannabinol, cannabidiol, or derivative thereof.

Figure 6:
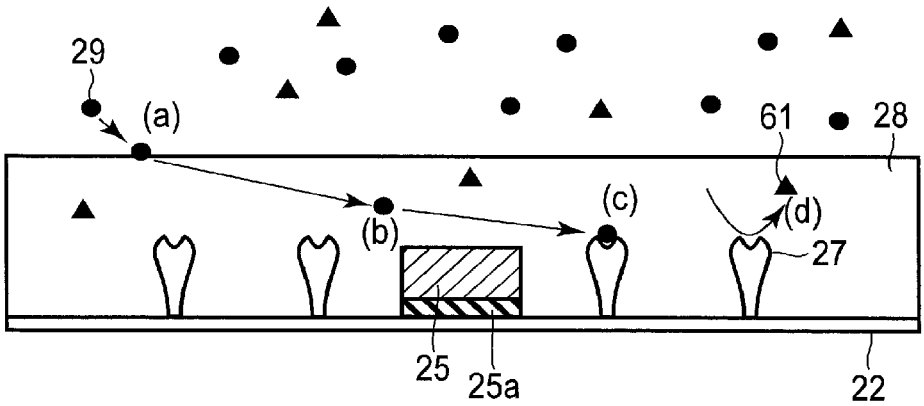
FIG. 6 illustrates an example of detection by the first chemical sensor incorporated in the fire detection system of the first embodiment.

Hereinafter, the detection of the first gas by the first chemical sensor 20 will be explained with reference to FIG. 6.

(S1): When the first gas 29 is generated in a space where the fire detection system 1 is disposed, the first gas 29 contacts the liquid membrane. The first gas 29 contacting the liquid membrane 28 further goes in the liquid membrane 28 ((a) and (b) of FIG. 6). Then, the first gas 29 is bound to the first receptor 27 ((c) of FIG. 6). On the other hand, other gas 61 (impurities or second gas) is not bound to the first receptor 27 ((d) of FIG. 6). Through the binding of the first gas 29 and the first receptor 27 ((c) of FIG. 6), the physical property of the membrane 22 changes. Here, the physical property means the electric resistance or the like of the membrane, for example.

(S2): The change in the physical property is detected as a change of electrical signal. The electrical signal is, for example, a current value, potential value, electric capacitance value, or impedance value. A change of electrical signal is, for example, increase, decrease, or vanish of the electrical signal, or a change of an accumulated value in a certain time. If the above-described graphene field effect transistor (may be referred to as graphene FET) is used, the change in the physical property can be detected as a change in the source/drain current value when a certain voltage is applied as a gate voltage and a drain voltage. Or, the change in the physical property may be detected as a change in the gate voltage value when the source/drain current value is maintained to a certain value. Data of the change of electrical signal are sent to, for example, a data processor electrically connected thereto, and stored and processed therein.

(S3): The change of electrical signal is output to the threshold value control part 31*a*, which will be described later, of the controller 30 as a detection signal. For example, if a change of electrical signal occurs, the first chemical sensor 20 determines that the first gas 29 exists and outputs a detection signal to the comparison part 32 of the controller 30. On the other hand, if a change of electrical signal does not occur, the first chemical sensor 20 determines that the first gas 29 does not exist and does not output a detection signal to the threshold value control part 31*a* of the controller 30.

The above-mentioned first chemical sensor is a graphene FET type chemical sensor; however, it is not limited thereto. As long as a biological material, antibody, or nucleic acid aptamer, or an artificial material such as molecule imprint are used as in the first receptor 27, the first chemical sensor may be a chemical sensor of other charge detection element such as a surface plasmon resonance (SPR) element, a surface acoustic wave (SAW) element, a film bulk acoustic resonance (FBAR) element, a quartz crystal microbalance (QCM) element, or a micro-electromechanical systems (MEMS) cantilever element.

The first chemical sensor 20 may further include a filter to cover the surface of the liquid membrane 28 of the first chemical sensor 20. The filter is, for example, a high efficiency particulate air (HEPA) filter which can prevent dust, insect, or the like which is greater than the first gas in size from entering in the first chemical sensor 20 from the outside and can prevent decrease of the detection performance of the first chemical sensor 20.

Figure 7:
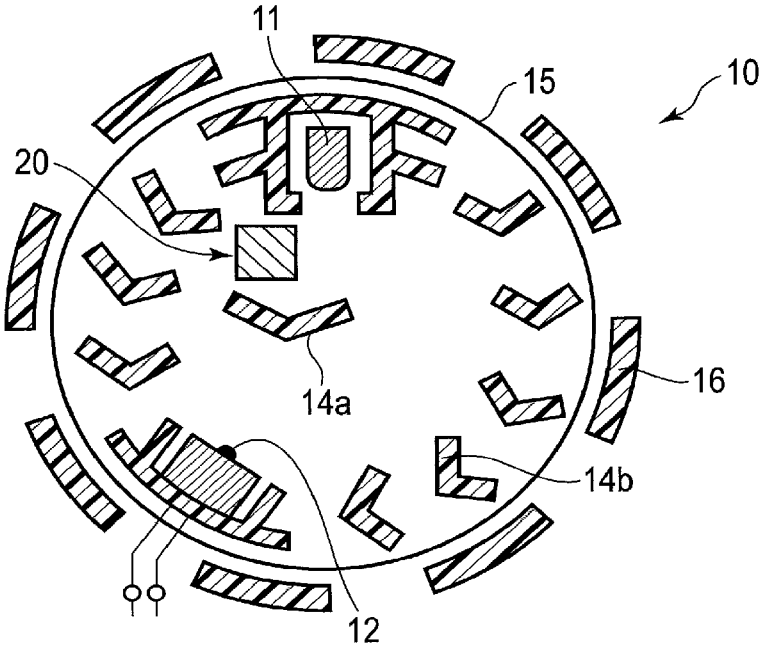
FIG. 7 illustrates an example where the first chemical sensor is disposed in the combustion gas detection sensor.

Furthermore, it is preferable that the first chemical sensor 20 be disposed in the combustion gas detection sensor 10 as shown in FIG. 7. When the first chemical sensor 20 is disposed in the combustion gas detection sensor 10, they can be attached to a desired place in a building, factory, or house as an integrated-type fire detection system 1.

The controller 30 includes, as shown in FIG. 1, the threshold value control part 31*a* and the comparison part 32.

The threshold value control part 31*a* receives the detection signal from the first chemical sensor 20 and outputs a preset threshold value to the comparison part 32 to which the detection signal from the combustion gas detection sensor 10 is input. Since the detection by the combustion gas detection sensor 10 is, as mentioned above, the intensity of scattered light, a threshold value is preset to correlate with the intensity of scattered light. In the setting of the threshold value, it is taken into consideration that the intensity of the scattered light of the combustion gas detection sensor 10 is increased by the combustion gas. Based on the above, the threshold value control part 31*a* sets a reference threshold value in consideration of the first gas and the smoke, detects the first gas with the first chemical sensor 20, and if a detection signal thereof is input to the threshold value control part 31*a*, controls to maintain the threshold value above the reference threshold value. Now, the operation of the threshold value control part 31*a* of the controller 30 will be indicated in Table 1 below.

TABLE 1

| | First gas | Operations |
|---|---|---|
| 1 | Detected | Increase threshold value from reference threshold value |
| 2 | Not detected | Maintain threshold value |

To the comparison part 32, the detection signal from the combustion gas detection sensor 10 and the threshold value from the threshold value control part 31*a* are input, respectively. That is, the comparison part 32 compares the threshold value from the threshold value control part 31*a* to the detection signal from the combustion gas detection sensor 10, and outputs an operation start signal of the alarm 40 when the value of the detection signal exceeds the threshold value. Upon input of the operation start signal from the comparison part 32 of the controller 30, the alarm 40 goes off with alarm sound such as ringing bell.

With a conventional fire detection system, there is a possibility that alarm goes off upon detection of the first gas which is, for example, a combustion gas generated when a meat is grilled even through there is not a fire incident. That is, there is a possibility of a false alarm.

On the other hand, the fire detection system 1 of the first embodiment includes the above-described combustion gas detection sensor 10, first chemical sensor 20, controller 30, and alarm 40, and is disposed in architectures such as a building, factory, or house. When the first chemical sensor 20 detects the first gas 29, the fire detection system 1 of the first embodiment outputs a detection signal to the threshold value control part 31*a* of the controller 30. Upon input of the detection signal by the first chemical sensor 20, the threshold value control part 31*a* controls a threshold value to be higher than a preset reference threshold value, and outputs the higher threshold value to the comparison part 32. The comparison part 32 receives the detection signal from the combustion gas detection sensor 10 and compares the detection signal to the higher threshold value. At that time, since the threshold value which is compared to the detection signal is sufficiently high as compared to the reference threshold value, the detection signal from the combustion gas detection sensor 10 does not exceed the threshold value. As a result, an operation start signal is not output from the comparison part 32 to the alarm 40, and a possibility of an erroneous activation of the alarm 40 because of the first gas can be reduced.

Furthermore, in the fire detection system 1 of the first embodiment, if the first chemical sensor 20 does not detect the first gas 29, the output of the detection signal to the threshold value control part 31*a* of the controller 30 is stopped. At that time, the threshold value control part 31*a* controls the threshold value to return to the original reference threshold value. As a result, if a signal of the reference threshold value from the threshold value control part 31*a* is output to the comparison part 32, and a detection signal is output from the combustion gas detection sensor 10 to the comparison part 32, the comparison part 32 compares the reference threshold value to the detection signal from the combustion gas detection sensor 10. In this comparison, if the value of the detection signal exceeds the reference threshold value, the comparison part 32 outputs an operation start signal to the alarm 40, and the alarm 40 goes off with alarm sound such as ringing bell. Thus, when the detection of the first gas by the first chemical sensor 20 is stopped, the threshold value is returned to the reference threshold value in the threshold value control part 31*a*, and the combustion gas can be detected, and thus, detection of an actual fire incident can be rapidly performed. Therefore, a fire detection system of high performance can be provided.

Figure 8:
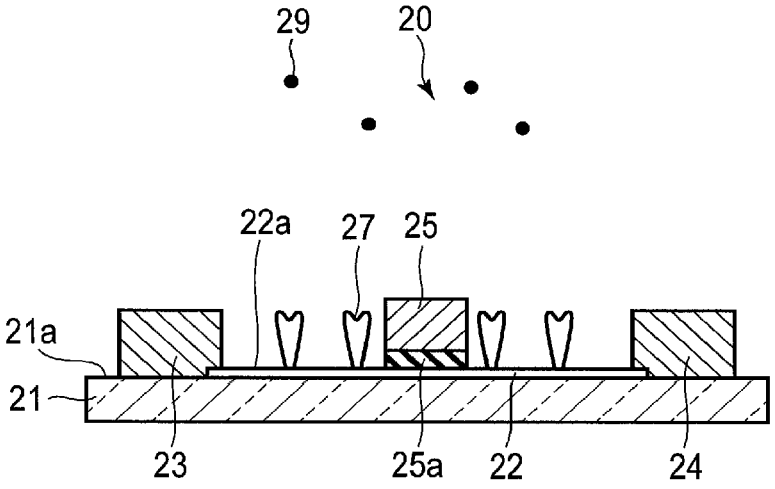
FIG. 8 illustrates another example of the longitudinal cross-sectional view of the first chemical sensor incorporated in the fire detection system of the first embodiment.

Note that the first chemical sensor 20 is not limited to the example of FIG. 4. If an artificial material such as a molecule imprint is used as the first receptor 27, a first chemical sensor from which the wall portion and the liquid membrane are omitted as in FIG. 8 can be formed.

Second Embodiment

Figure 9:
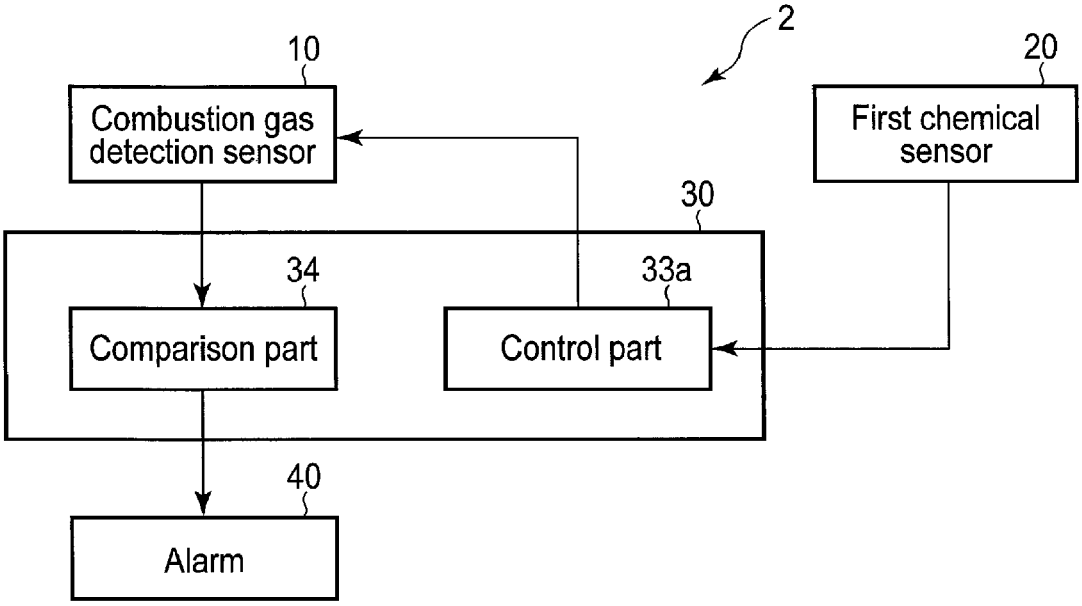
FIG. 9 illustrates an example of a fire detection system of a second embodiment.

FIG. 9 illustrates an example of a fire detection system of a second embodiment. The fire detection system 2 of the second embodiment includes a combustion gas detection sensor 10, first chemical sensor 20, controller 30, and alarm 40. The controller 30 includes a control part 33*a* and a comparison part 34. In FIG. 9, the same elements as in FIG. 1 will be referred to by the same reference numbers and the explanation thereof will be omitted.

The control part 33*a* receives a detection signal from the first chemical sensor 20 and outputs a signal to decrease a light receiving sensitivity to the light receiving element 12 of the combustion gas detection sensor 10. With this structure, the control part 33*a* detects a first gas with the first chemical sensor 20, and when a detection signal thereof is input in the combustion gas detection sensor 10, controls the light receiving element 12 of the combustion gas detection sensor 10 to decrease the light receiving sensitivity.

The comparison part 34 has a reference threshold value, and is input the detection signal from the combustion gas detection sensor 10. That is, the comparison part 34 compares the reference threshold value to the detection signal from the combustion gas detection sensor 10, and if the value of the detection signal exceeds the threshold value, the comparison part 34 outputs an operation start signal to the alarm 40. Upon input of the operation start signal from the comparison part 34 of the controller 30, the alarm 40 goes off with alarm sound such as ringing bell.

The fire detection system 2 of the second embodiment includes the above-described combustion gas detection sensor 10, first chemical sensor 20, controller 30, and alarm 40, and is disposed in architectures such as a building, factory, or house. When the first chemical sensor 20 detects the first gas 29, the fire detection system 2 of the second embodiment outputs a detection signal to the control part 33*a* of the controller 30. Upon input of the detection signal by the first chemical sensor 20, the control part 33*a* outputs a signal to decrease the light receiving sensitivity to the light receiving element 12 of the combustion gas detection sensor 10. The comparison part 34 receives the detection signal from the combustion gas detection sensor 10 and compares the detection signal to a reference threshold value. At that time, since the detection signal from the combustion gas detection sensor 10 is sufficiently low as compared to the reference threshold value, the detection signal from the combustion gas detection sensor 10 does not exceed the threshold value. As a result, an operation start signal is not output from the comparison part 34 to the alarm 40, and a possibility of an erroneous activation of the alarm 40 because of the first gas can be reduced.

Furthermore, in the fire detection system 2 of the second embodiment, if the first chemical sensor 20 does not detect the first gas 29, the output of the detection signal to the control part 33*a* of the controller 30 is stopped. At that time, the control part 33*a* controls the light receiving element 12 of the combustion gas detection sensor 10 to regain the original light receiving sensitivity. As a result, if a detection signal is output from the combustion gas detection sensor 10 to the comparison part 34, the comparison part 34 compares the reference threshold value to the detection signal from the combustion gas detection sensor 10. In this comparison, if the value of the detection signal exceeds the reference threshold value, the comparison part 34 outputs an operation start signal to the alarm 40, and the alarm 40 goes off with alarm sound such as ringing bell. Thus, when the detection of the first gas by the first chemical sensor 20 is stopped, the light receiving sensitivity of the light receiving element 12 of the combustion gas detection sensor 10 is returned to the original light receiving sensitivity, and the combustion gas can be detected, and thus, detection of an actual fire incident can be rapidly performed. Therefore, a fire detection system of high performance can be provided.

Third Embodiment

Figure 10:
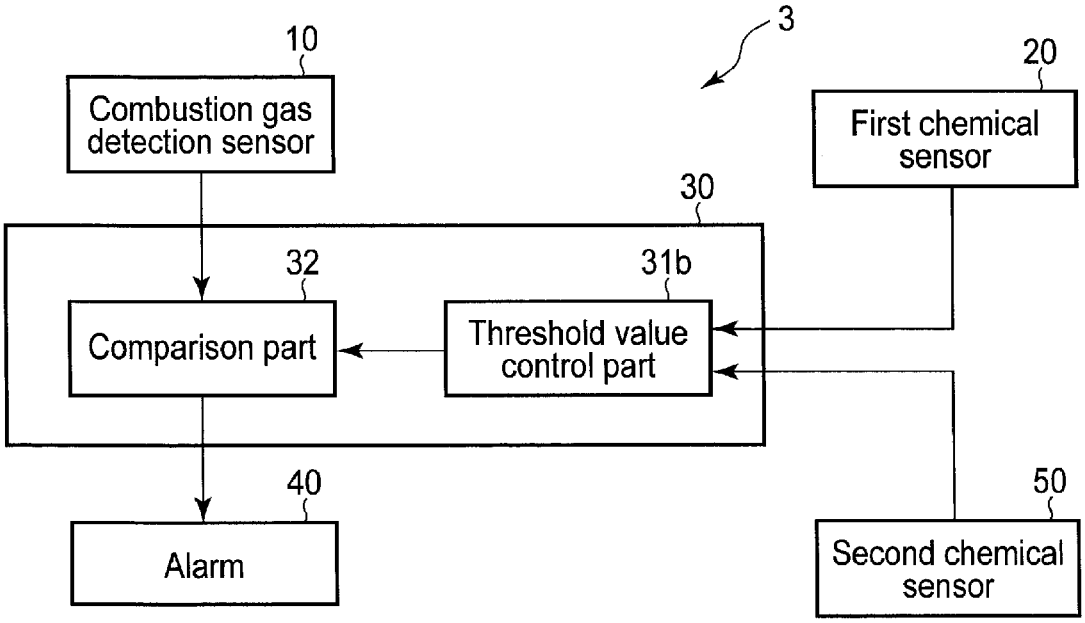
FIG. 10 illustrates an example of a fire detection system of a third embodiment.

FIG. 10 illustrates an example of a fire detection system of a third embodiment. The fire detection system 3 of the third embodiment includes a combustion gas detection sensor 10, first chemical sensor 20, controller 30, alarm 40, and second chemical sensor 50. The controller 30 includes a threshold value control part 31*b* and a comparison part 32. In FIG. 10, the same elements as in FIG. 1 will be referred to by the same reference numbers and the explanation thereof will be omitted.

Upon detection of a second gas, the second chemical sensor 50 outputs a detection signal to the threshold value control part 31*b* of the controller 30. The second gas is, in this application, particles of combustion gas which may be generated with a high possibility in a fire incident. The combustion gas may contain the second gas. The comparison part 32 of the controller 30 outputs or does not output an operation start signal to the alarm 40 based on the detection signal from the combustion gas detection sensor 10 and the threshold value from the threshold value control part 31*b*. The alarm 40 operates based on the operation start signal from the comparison part 32 of the controller 30 and notifies fire.

Figure 11:
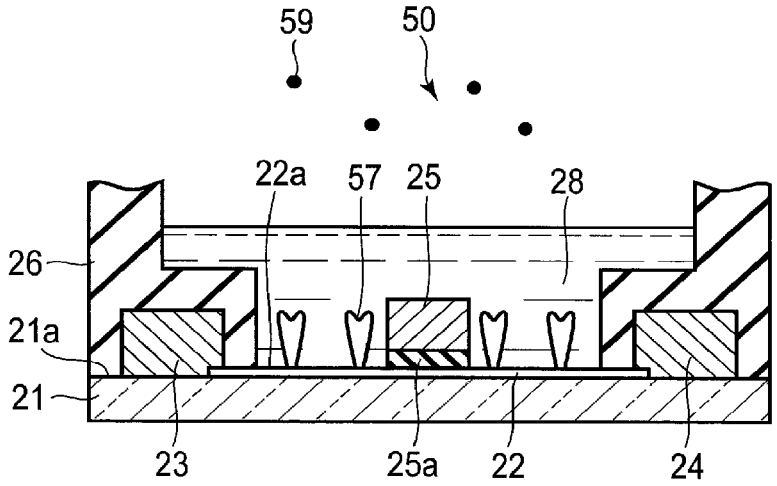
FIG. 11 illustrates a longitudinal cross-sectional view of the second chemical sensor incorporated in the fire detection system of the third embodiment.
Figure 12:
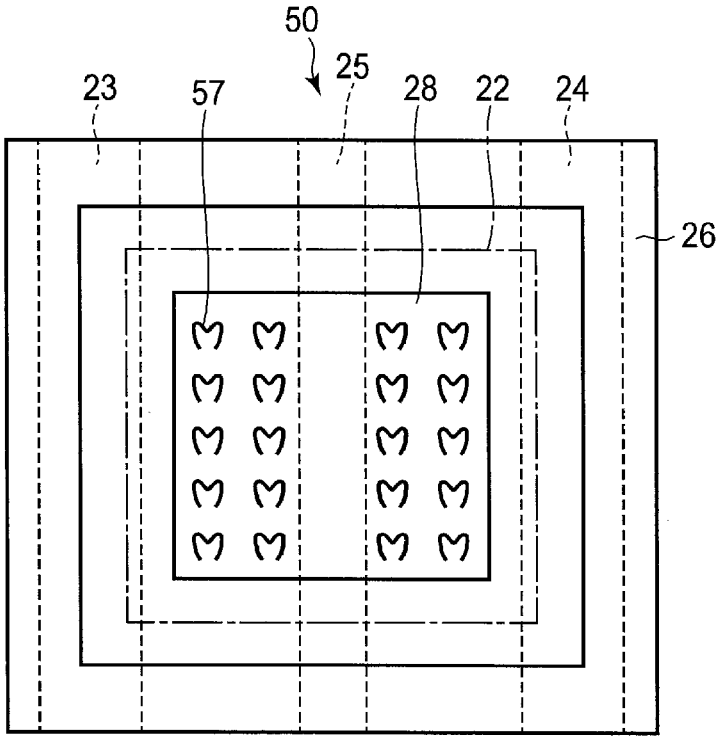
FIG. 12 illustrates a plan view of the second chemical sensor incorporated in the fire detection system of the third embodiment.

FIG. 11 illustrates a longitudinal cross-sectional view of the second chemical sensor incorporated in the fire detection system of the third embodiment. FIG. 12 illustrates a plan view of the second chemical sensor incorporated in the fire detection system of the third embodiment. The second chemical sensor 50 is basically the same as the first chemical sensor 20 except for including a second receptor 57 instead of the first receptor 27 as compared to the first chemical sensor 20. In FIGS. 11 and 12, the same elements as in FIGS.

4 and 5 will be referred to by the same reference numbers and the explanation thereof will be omitted.

The second receptor 57 is, for example, a biological material. As the second receptor 57, for example, a fragment of an olfactory receptor can be used. The second receptor 57 is a fragment of an olfactory receptor including a sequence of a site binding to the second gas 59. For example, such a sequence includes a ligand binding site positioned outside the cell of the olfactory receptor. The second receptor 57 can be produced by, for example, obtaining an amino acid sequence of the ligand binding side from a database of the olfactory receptors, and synthesizing an oligopeptide having the same amino acid sequence. The second receptor 57 may be a substance binding to the second gas 59, for example, may be a substance of which a sequence of a ligand binding site is partially changed, or may be a substance to which a new sequence is added. As the olfactory receptor, for example, an olfactory receptor of an animal can be used for the second receptor 57. Examples of the animal include a vertebrate or an insect. For example, an olfactory receptor of a human, a mouse, a fly, or the like can be used.

Furthermore, the second receptor 57 may be those binds to the second gas 59, an antibody, a nucleic acid aptamer, or an artificial material such as molecular imprint. If the second receptor 57 is an artificial material such as molecule imprint, the second receptor 57 is difficult to be denaturalized or deteriorated by drying.

The second receptor 57 can be connected to the membrane 22 by adding a modification group to the second receptor 57 and/or the membrane 22 and binding them through chemical synthesize. Furthermore, the second receptor 57 can be connected to the membrane 22 by being disposed on the surface 22*a* of the membrane 22.

The second gas 59 is particles of combustion gas which has a high possibility of generation in a fire incident. The second gas 59 may be a material included in the air and may be a ligand of animal olfactory receptor, for example. The second gas 59 is, for example, an aromatic compound, aliphatic compound, or aldehyde compound which will be generated when a wood or a building is burnt.

The aromatic compound is, for example, benzene, toluene, acetophenone, benzyl alcohol, 4-ethyl-methoxyphenol, 2-methoxyphenol, 2-methoxy-4-methylphenol, 2-methylphenol, 3-methylphenol, 4-methylphenol, or naphthalene.

The aliphatic compound is, for example, isopentane, pentane, 1-pentene, propane, or hexane.

The aldehyde compound is, for example, propionaldehyde, furfuryl aldehyde, N-butyraldehyde, N-valeraldehyde, 2-hydroxybenzaldehyde, or 2-hydroxy-5-methylbenzenaldehyde.

Figure 13:
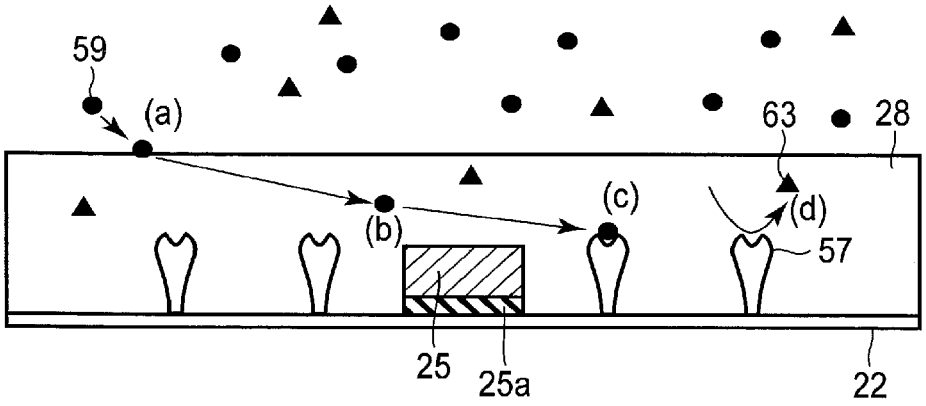
FIG. 13 illustrates an example of detection by a second chemical sensor incorporated in the fire detection system of the third embodiment.

Hereinafter, the detection of second gas by the second chemical sensor 50 will be explained with reference to FIG. 13.

(S1): When the second gas 59 is generated in a space where the fire detection system 2 is disposed, the second gas 59 contacts the liquid membrane 28. The second gas 59 contacting the liquid membrane 28 further goes in the liquid membrane 28 ((a) and (b) of FIG. 13). Then, the second gas 59 is bound to the second receptor 57 ((c) of FIG. 13). On the other hand, other gas 63 (impurities or first gas) is not bound to the second receptor 57 ((d) of FIG. 13). Through the binding of the second gas 59 and the second receptor 57 ((c) of FIG. 13), the physical property of the membrane 22 changes. Here, the physical property means the electric resistance or the like of the membrane, for example.

(S2): The change in the physical property is detected by a change in an electrical signal. Examples of the electrical signal include a current value, potential value, an electric capacitance value, or an impedance value. The change in electrical signal is, for example, an increase, a decrease, or loss of the electrical signal, or a change in an integrated value within a certain time. If the above-described graphene FET is used, the change in the physical property can be detected as a change in the source/drain current value when a certain voltage is applied as a gate voltage and a drain voltage. Or, the change in the physical property may be detected as a change in the gate voltage value when the source/drain current value is maintained to a certain value. Data of the change of electrical signal are send to, for example, a data processor electrically connected thereto, and stored and processed therein.

(S3): The change of electrical signal is output to the threshold value control part 31*b*, which will be described later, of the controller 30 as a detection signal. For example, if a change of electrical signal occurs, the second chemical sensor 50 determines that the second gas 59 exists and outputs a detection signal to the comparison part 32 of the controller 30. On the other hand, if a change of electrical signal does not occur, the second chemical sensor 50 determines that the second gas 59 does not exist and does not output a detection signal to the threshold value control part 31*b* of the controller 30.

The above-mentioned second chemical sensor is a graphene FET type chemical sensor; however, it is not limited thereto. As long as a biological material, antibody, or nucleic acid aptamer, or an artificial material such as molecule imprint are used as in the second receptor 57, the first chemical sensor may be a chemical sensor of other charge detection element such as a SPR element, a SAW element, a FBAR element, a QCM element, or a MEMS cantilever element.

The second chemical sensor 50 may further include a filter to cover the surface of the liquid membrane 28 of the second chemical sensor 50. The filter is, for example, a high efficiency particulate air (HEPA) filter which can prevent dust, insect, or the like which is greater than the second gas in size from entering in the second chemical sensor 50 from the outside and can prevent decrease of the detection performance of the second chemical sensor 50.

Figure 14:
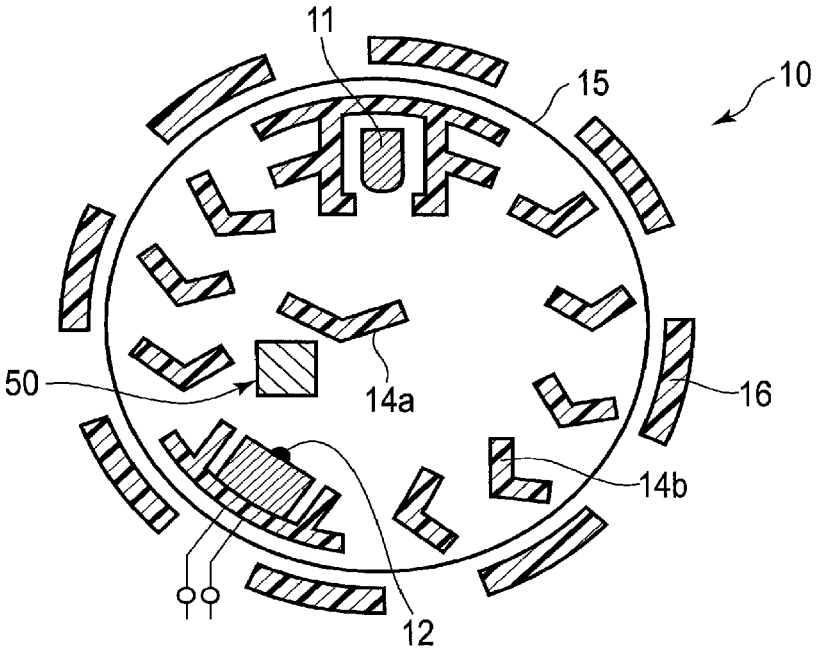
FIG. 14 illustrates an example where the second chemical sensor is disposed in the combustion gas detection sensor.

Furthermore, it is preferable that the second chemical sensor 50 should be disposed in the combustion gas detection sensor 10 as in FIG. 14. When the second chemical sensor 50 is disposed in the combustion gas detection sensor 10, they can be attached to a desired place in a building, factory, or house as an integrated-type fire detection system 2.

Figure 15:
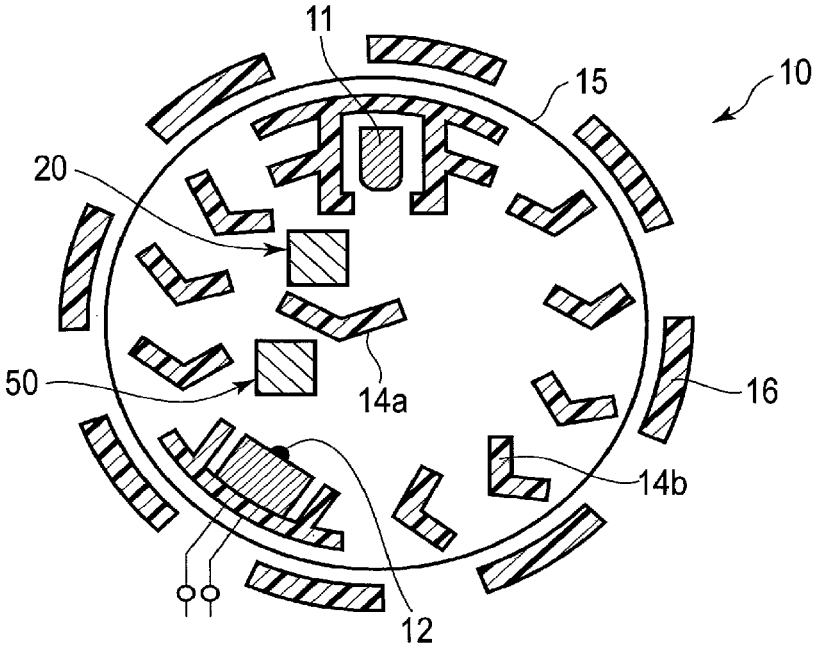
FIG. 15 illustrates an example where first and second chemical sensors are disposed in the combustion gas detection sensor.

Furthermore, it is preferable that the second chemical sensor 50 should be disposed in the combustion gas detection sensor 10 with the first chemical sensor 20 as in FIG. 15. When the first and second chemical sensors 20 and 50 are both disposed in the combustion gas detection sensor 10, they can be attached to a desired place in a building, factory, or house as an integrated-type fire detection system 2.

The controller 30 includes, as shown in FIG. 10, the threshold value control part 31*b* and the comparison part 32.

The threshold value control part 31*b* receives the detection signal from the first and second chemical sensors 20 and 50 and outputs a preset threshold value to the comparison part 32 to which the detection signal from the combustion gas detection sensor 10 is input. Since the detection by the combustion gas detection sensor 10 is, as mentioned above, the intensity of scattered light, a threshold value is preset to correlate with the intensity of scattered light. In the setting of the threshold value, it is taken into consideration that the intensity of the scattered light of the combustion gas detection sensor 10 is increased not only by the combustion gas but also by the second gas. Based on the above, the threshold value control part 31*b* sets a reference threshold value in consideration of the combustion gas and the second gas, detects the first gas with the first chemical sensor 20, and if a detection signal thereof is input to the threshold value control part 31*b*, controls to increase the threshold value above the reference threshold value.

Furthermore, the threshold value control part 31*b* detects the second gas with the second chemical sensor 50, and if a detection signal thereof is input to the threshold value control part 31*b*, controls to decrease the threshold value below the reference threshold value.

Furthermore, the threshold value control part 31*b* detects the first gas with the first chemical sensor 20 and detects the second gas with the second chemical sensor 50, and if each detection signal is input in the threshold value control part 31*b*, controls to maintain the threshold value to be equal to the reference threshold value. Now, the operation of the threshold value control part 31*b* of the controller 30 will be indicated in Table 2 below.

TABLE 2

| | First gas | Second gas | Operation |
|---|---|---|---|
| 1 | Detected | Not detected | Increase threshold value from reference threshold value |
| 2 | Not detected | Not detected | Maintain reference threshold value |
| 3 | Not detected | Detected | Decrease threshold value from reference threshold value |
| 4 | Detected | Detected | Maintain reference threshold value |

To the comparison part 32, the detection signal from the combustion gas detection sensor 10 and the threshold value from the threshold value control part 31*b* are input. That is, the comparison part 32 compares the threshold value from the threshold value control part 31*b* to the detection signal from the combustion gas detection sensor 10, and outputs an operation start signal of the alarm 40 when he value of the detection signal exceeds the threshold value. Upon input of the operation start signal from the comparison part 32 of the controller 30, the alarm 40 goes off with alarm sound such as ringing bell.

The fire detection system 3 of the third embodiment includes the above-described combustion gas detection sensor 10, first chemical sensor 20, controller 30, alarm 40, and second chemical sensor 50, and is disposed in architectures such as a building, factory, or house. Since the fire detection system 3 of the third embodiment includes the first chemical sensor 20, it operates the same as the fire detection system 1 of the first embodiment, and also operates as follows because of the second chemical sensor 50.

When the second chemical sensor 50 detects the second gas 59, the fire detection system 3 of the third embodiment outputs a detection signal to the threshold value control part 31*b* of the controller 30. Upon input of the detection signal by the second chemical sensor 50, the threshold value control part 31*b* controls the threshold value to be lower than the preset reference threshold value and outputs the lower threshold value to the comparison part 32. The comparison part 32 receives the detection signal from the combustion gas detection sensor 10 and compares the detection signal to the lower threshold value. At that time, since the threshold value which is compared to the detection signal is sufficiently low as compared to the reference threshold value, the detection signal from the combustion gas detection sensor 10 tends to exceed the threshold value. As a result, an operation start signal is output from the comparison part 32 to the alarm 40, and the combustion gas can be detected, and thus, detection of an actual fire incident can be rapidly performed.

Furthermore, in the fire detection system 3 of the third embodiment, if the second chemical sensor 50 does not detect the second gas 59, the output of the detection signal to the threshold value control part 31*b* of the controller 30 is stopped. At that time, the threshold value control part 31*b* controls the threshold value to return to the original reference threshold value. As a result, if a signal of the reference threshold value from the threshold value control part 31*b* is output to the comparison part 32 and a detection signal is output from the combustion gas detection sensor 10 to the comparison part 32, the comparison part 32 compares the reference threshold value to the detection signal from the combustion gas detection sensor 10. In this comparison, if the value of the detection signal does not exceed the reference threshold value, the comparison part 32 does not output an operation start signal to the alarm 40. As a result, an operation start signal is not output from the comparison part 32 to the alarm 40, and a possibility of an erroneous activation of the alarm 40 can be reduced. Therefore, a fire detection system of high performance can be provided.

Figure 16:
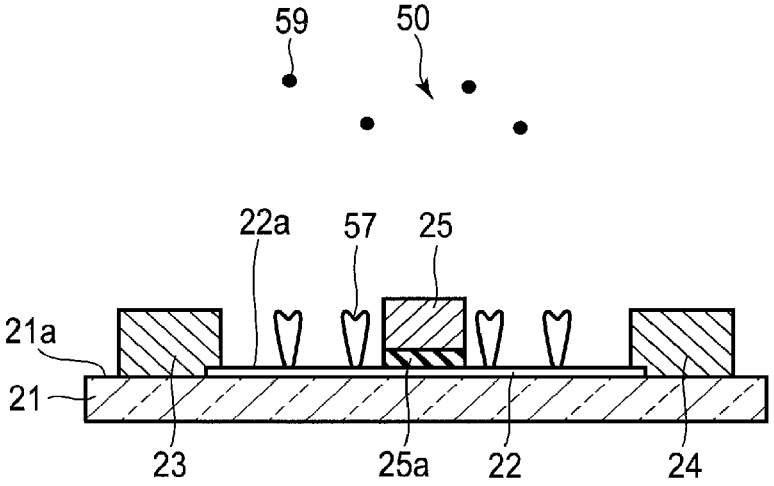
FIG. 16 illustrates another example of a longitudinal cross-sectional view of the second chemical sensor incorporated in the fire detection system of the third embodiment.

Note that the second chemical sensor 50 is not limited to the example of FIG. 11. If an artificial material such as a molecule imprint is used as the second receptor 57, a second chemical sensor from which the wall portion and the liquid membrane are omitted as in FIG. 16 can be formed.

Fourth Embodiment

Figure 17:
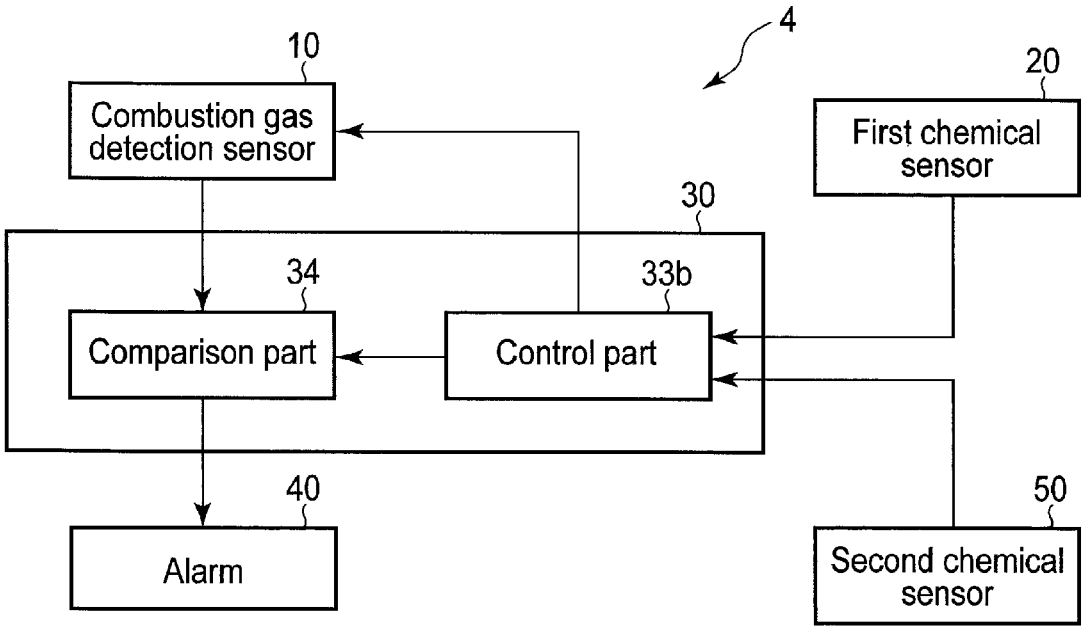
FIG. 17 illustrates an example of a fire detection system of a fourth embodiment.

FIG. 17 illustrates an example of a fire detection system of a fourth embodiment. The fire detection system 4 of the fourth embodiment includes a combustion gas detection sensor 10, first chemical sensor 20, controller 30, alarm 40, and second chemical sensor 50. The controller 30 includes a control part 33*b* and a comparison part 34. In FIG. 17, the same elements as in FIGS. 1 and 8 will be referred to by the same reference numbers and the explanation thereof will be omitted.

The control part 33*b* receives a detection signal from the first chemical sensor 20 and outputs a signal to decrease a light receiving sensitivity to the light receiving element 12 of the combustion gas detection sensor 10. With this structure, the control part 33*b* detects a first gas with the first chemical sensor 20, and when a detection signal thereof is input in the combustion gas detection sensor 10, controls the light receiving element 12 of the combustion gas detection sensor 10 to decrease the light receiving sensitivity.

Furthermore, control part 33*b* receives a detection signal from the second chemical sensor 50 and outputs a signal to increase the light receiving sensitivity to the light receiving element 12 of the combustion gas detection sensor 10. With this structure, the control part 33*b* detects a second gas with the second chemical sensor 50, and when a detection signal thereof is input in the combustion gas detection sensor 10, controls the light receiving element 12 of the combustion gas detection sensor 10 to increase the light receiving sensitivity.

Furthermore, upon input of the detection signal from the first chemical sensor 20 and the detection signal from the second chemical sensor 50, the control part 33*b* outputs a signal to increase or decrease the light receiving sensitivity to the light receiving element 12 of the combustion gas detection sensor 10. With this structure, the control part 33*b* detects the second gas with the second chemical sensor, and when a detection signal thereof is input in the combustion gas detection sensor 10, controls the light receiving element 12 of the combustion gas detection sensor 10 to maintain the light receiving sensitivity as is.

The comparison part 34 has a reference threshold value, and is input the detection signal from the combustion gas detection sensor 10. That is, the comparison part 34 compares the reference threshold value to the detection signal from the combustion gas detection sensor 10, and if the value of the detection signal exceeds the threshold value, the comparison part 34 outputs an operation start signal to the alarm 40. Upon input of the operation start signal from the comparison part 34 of the controller 30, the alarm 40 goes off with alarm sound such as ringing bell.

The fire detection system 4 of the fourth embodiment includes the above-described combustion gas detection sensor 10, first chemical sensor 20, controller 30, alarm 40, and second chemical sensor 50, and is disposed in architectures such as a building, factory, or house. Since the fire detection system 4 of the fourth embodiment includes the first chemical sensor 20, it operates the same as the fire detection system 2 of the second embodiment, and also operates as follows because of the second chemical sensor 50.

When the second chemical sensor 50 detects the second gas 59, the fire detection system 4 of the fourth embodiment outputs a detection signal to the control part 33*b* of the controller 30. Upon input of the detection signal by the second chemical sensor 50, the control part 33*b* outputs a signal to increase a light receiving sensitivity to the light receiving element 12 of the combustion gas detection sensor 10. The comparison part 34 is input the detection signal from the combustion gas detection sensor 10 and compares the detection signal to a reference threshold value. At that time, since the threshold value which is compared to the detection signal is sufficiently high as compared to the reference threshold value, the detection signal from the combustion gas detection sensor 10 tends to exceed the threshold value. As a result, an operation start signal is output from the comparison part 34 to the alarm 40, and the combustion gas can be detected, and thus, detection of an actual fire incident can be rapidly performed.

Furthermore, in the fire detection system 4 of the fourth embodiment, if the second chemical sensor 50 does not detect the second gas 59, the output of the detection signal to the control part 33*b* of the controller 30 is stopped. At that time, the control part 33*b* controls the light receiving sensitivity of the light receiving element 12 of the combustion gas detection sensor 10 to return to the original light receiving sensitivity. As a result, if a detection signal from the combustion gas detection sensor 10 is output to the comparison part 34, the comparison part 34 compare the reference threshold value to the detection signal from the combustion gas detection sensor 10. In this comparison, if the value of the detection signal does not exceed the reference threshold value, the comparison part 34 does not output an operation start signal to the alarm 40. As a result, an operation start signal is not output from the comparison part 34 to the alarm 40, and a possibility of an erroneous activation of the alarm 40 can be reduced. Therefore, a fire detection system of high performance can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fire detection system comprising:

a combustion gas detection sensor;

a first chemical sensor configured to detect a first gas which are particles of combustion gas generated with a low possibility in a fire incident; and an alarm configured to operate based on detection signals of the combustion gas detection sensor and the first chemical sensor and notify fire, wherein the first chemical sensor includes a first membrane and a first receptor which is a biological or artificial material specifically binding to the first gas and is connected to a surface of the first membrane, and the first chemical sensor detects the change of a physical property of the first membrane in order to detect the first gas.

2. The fire detection system of claim 1, further comprising a controller configured to receive detection signals from each of the combustion gas detection sensor and the first chemical sensor and to output an operation start signal to the alarm.

3. A fire detection system comprising:

a combustion gas detection sensor;

a first chemical sensor configured to detect a first gas;

a second chemical sensor configured to detect a second gas; and an alarm configured to operate based on detection signals of the combustion gas detection sensor, the first chemical sensor, and the second chemical sensor and notify fire, a controller configured to receive detection signals from each of the combustion gas detection sensor, the first chemical sensor, and the second chemical sensor, and to output an operation start signal to the alarm, wherein the first chemical sensor includes a first membrane and detects the change of a physical property of the first membrane in order to detect the first gas, the second chemical sensor includes a second membrane and detects the change of a physical property of the second membrane in order to detect the second gas, and the controller is configured to maintain a reference threshold value set to the controller if the first chemical sensor detects the first gas and the detection signal is input to the controller, and the second chemical sensor detects the second gas and the detection signal is input to the controller.

4. The fire detection system of claim 2, wherein the controller is configured to raise a reference threshold value set to the controller if the first chemical sensor detects the first gas and the detection signal is input to the controller.

5. The fire detection system of claim 3, wherein the controller is configured to raise a reference threshold value set to the controller if the first chemical sensor detects the first gas and the detection signal is input to the controller.

6. The fire detection system of claim 3, wherein the controller is configured to lower a reference threshold value set to the controller if the second chemical sensor detects the second gas and the detection signal is input to the controller.

7. The fire detection system of claim 1, wherein the first gas is a decomposition product of a protein, cigarette burn ingredient, or insecticide/germicide smoke agent ingredient.

8. The fire detection system of claim 3, wherein the second gas is an aromatic compound, aliphatic compound, or aldehyde compound.

9. The fire detection system of claim 3, further comprising a second receptor connected to a surface of the second membrane.

10. The fire detection system of claim 1, wherein the first chemical sensor further includes a filter to cover the first membrane and the first receptor.

11. The fire detection system of claim 9, wherein the second chemical sensor further includes a filter to cover the second membrane and the second receptor.

12. The fire detection system of claim 1, wherein the first chemical sensor is disposed in the combustion gas detection sensor.

13. The fire detection system of claim 3, wherein the second chemical sensor is disposed in the combustion gas detection sensor.

14. The fire detection system of claim 3, wherein the first and second chemical sensors are disposed in the combustion gas detection sensor, respectively.

15. The fire detection system of claim 1, wherein the first receptor includes a sequence of a site of binding to the first gas, and is at least one of: a fragment of an olfactory receptor; an antibody; a nucleic acid aptamer; molecular imprint.

16. The fire detection system of claim 1, further comprising a blocking agent and a liquid membrane covering on the surface of the first membrane, and the first receptor is in the liquid membrane configured to project from the blocking agent.

* * * * *